US006312360B1

(12) United States Patent
Shiban

(10) Patent No.: US 6,312,360 B1
(45) Date of Patent: Nov. 6, 2001

(54) ARM AND HAND EXERCISING DEVICE

(76) Inventor: Samir S. Shiban, 367 W. Chicago St., Chandler, AZ (US) 85225-9559

( * ) Notice: Subject to any disclaimer, the term of this patent is extended or adjusted under 35 U.S.C. 154(b) by 0 days.

(21) Appl. No.: 09/562,513

(22) Filed: May 1, 2000

(51) Int. Cl.[7] ..... A63B 23/00
(52) U.S. Cl. ..... 482/49
(58) Field of Search ..... 482/44–50

(56) References Cited

U.S. PATENT DOCUMENTS 4,328,964 * 5/1982 Walls ..... 482/129
4,711,445 * 12/1987 Whitehead ..... 482/49
5,399,136 * 3/1995 Bart ..... 482/110
5,423,730 * 6/1995 Hirsch ..... 482/92

* cited by examiner

*Primary Examiner*—Glenn E. Richman
(74) *Attorney, Agent, or Firm*—James D. Givnan, Jr.

(57) ABSTRACT

A resilient ball is supported in place on a chair, exercising equipment or other support by a strap or metal clip for periodic exercising of hand and arm muscles. The strap may be one piece or segmented and provided with fabric closure pieces. The ball is secured to the strap or clip by a threaded fastener or a tensionable cord. Non-metallic elements isolate the threaded fasteners from damaging contact with supporting structures.

3 Claims, 2 Drawing Sheets

ARM AND HAND EXERCISING DEVICE

BACKGROUND OF THE INVENTION

The present invention pertains generally to devices for exercising arm and hand muscles by repeated contraction of the hand about a resilient body.

It is well established in the practice of physical therapy that benefits may be obtained by periodic exercising of the hand and arm muscles by the grasping and compressing of a resilient body, as for example a small ball. While the foregoing may be accepted, for one reason or another it is apparently not a common practice. A possible explanation may be that a small resilient body such as a ball is stored in a drawer or desk and forgotten, at least as far as part of a daily exercise routine. As with any exercising aid regular use is necessary to achieve maximum benefits. Not known to the applicant are any compressible or resilient bodies provided with means for attaching same to furniture or exercise equipment to promote their frequent use and serve as a constant reminder of the need for including same in a daily exercise routine.

SUMMARY OF THE PRESENT INVENTION

The present invention is embodied within a compressible body of a size to fit within the hand of the user and including attachment means for mounting of the compressible member on various frequently encountered supports.

The present arm and hand exercising device is provided with attachment means permitting attachment of the device to chairs as well as various pieces of exercise equipment. Such attachment means may include straps carried by the compressible member and having fabric closure segments facilitating attachment to chair structure to enable convenient exercise of the hand and arm by the user while seated at a job site. Other attachment means include straps for attachment to a tubular component of an exercycle or treadmill, etc., for hand and arm flexing during other exercising efforts. A clip-on type attachment means facilitates attachment of the compressible member by frictional engagement of yieldable members shaped to engage a structural member of a chair, gearshift or exercising device. One embodiment of the invention includes a resilient housing in which a fastener component of the attachment means is isolated from damaging contact with chair arm structure.

Important objectives of the present invention include the provision of a compressible body provided with attachment means to permit secure attachment of the body to various structures including chairs and exercising equipment; the provision of an exercising device with compressible body for manual squeezing in intermittent fashion with the user seated in a chair or utilizing exercising equipment; the provision of a compressible body having attachment means for securement to a chair in a secure manner yet without damage to the supporting structure of the chair; the provision of an exercising device including a ball of resilient construction wherein the attachment means is at least partially concealed within a sleeve to prevent loss and/or disassembly by a child.

BRIEF DESCRIPTION OF THE DRAWINGS

In the drawings:

FIG. 6 discloses a still further modified attachment means of the clip-on type.

DETAILED DESCRIPTION OF THE PREFERRED EMBODIMENTS

Figure 1:
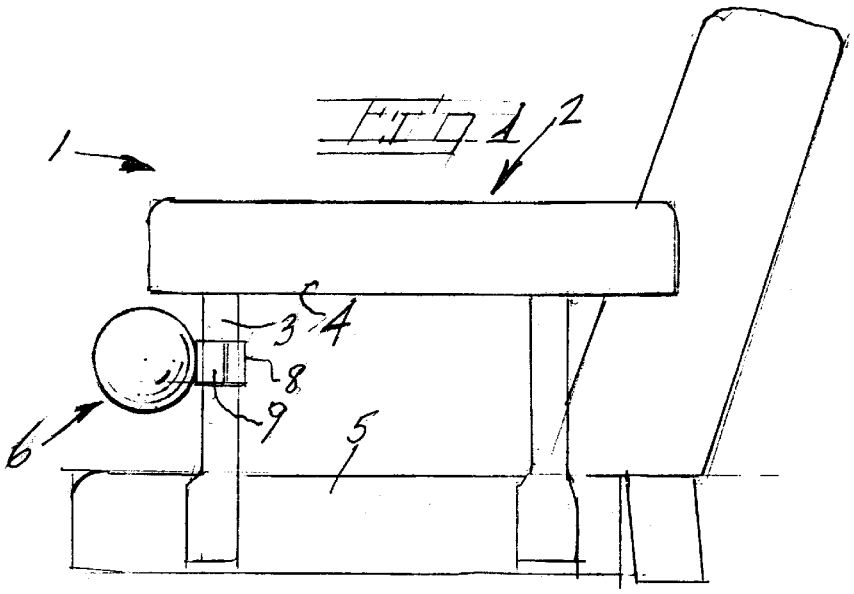
FIG. 1 is a side elevational view of a chair with the present invention in place on chair arm structure.
Figure 2:
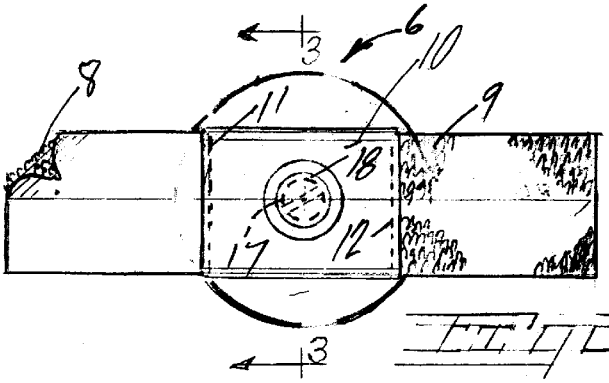
FIG. 2 is a front elevational view of the device of FIG. 1 with the compressible element shown in phantom lines and fabric closure straps separated from a support.

With continuing attention to the drawings wherein applied reference numerals indicate parts similarly hereinafter identified, the reference numeral 1 indicates generally a chair having arm structure at 2 including an upright support 3 and an arm 4. The chair seat is at 5.

Indicated generally at 6 is compressible member of a resiliency to permit partial compression of same by the closure of the user's fingers thereabout. The closing and opening movement of the fingers serves to exercise hand and arm muscles which is most beneficial when done over a short period of time at frequent intervals. A ball may serve as a compressible member.

Figure 3:
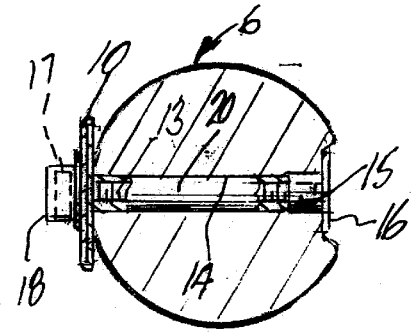
FIG. 3 is a vertical sectional view taken along line 3—3 of FIG. 2.

Attachment means, in one version of the invention, includes straps at 8 and 9 each bearing one part of a fabric closure including hook and loop pieces. Pieces 8 and 9 terminate at their respective ends within a sleeve 10 and are secured thereto by stitching at 11 and 12. A fastener element includes a threaded shaft 13 (FIG. 3) extending through an opening 14 in resilient member 6. A nut 15 includes an outer flange 16. A head 17 of the fastener is preferably housed within a cover 18 which may be in the form of a plastic cap to prevent damage to any article about which the fabric closure straps are attached. The attachment means preferably includes a non-metallic sleeve 20, substantially co-extensive with threaded shaft 13, to isolate the resilient material of member 6 from the threads of shaft 13.

Figure 4:
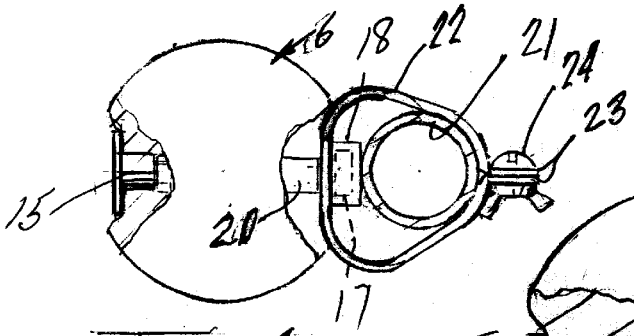
FIG. 4 shows a side elevational view of the present device including modified attachment means.

With attention to FIG. 4, a compressible member 6 with the attachment means above described but using a strap 22 of elastomeric material and a fastener 24 to secure the strap to a tubular member 21. Additional attachment means are identified by those reference numerals used in the first described form of the invention.

Figure 5:
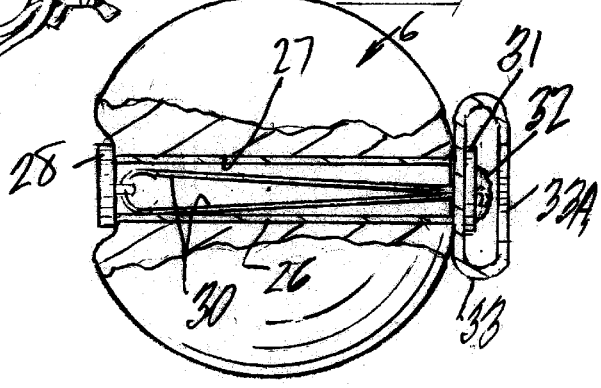
FIG. 5 is a side elevational view of the device disclosing a still further modified attachment means.
Figure 4:
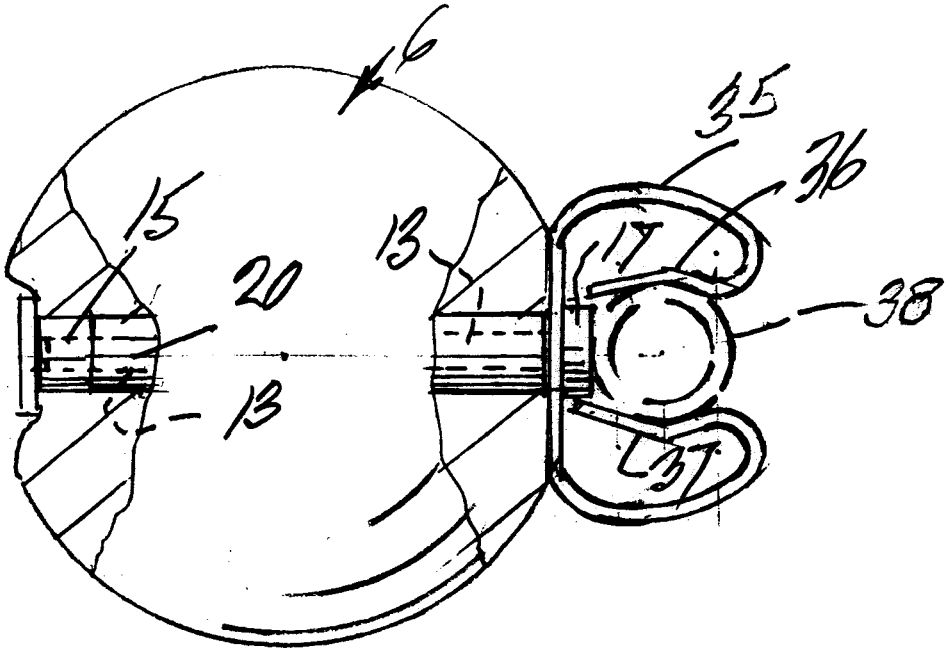

In FIG. 5, resilient member 6 is provided attachment means including a tubular member 26 extending through an opening 27 in resilient member 6. A button 28 is seated against member 6 by a fastener element 30 which is shown as a cord, preferably elastic, with its ends fastened to a washer 31 by an adhesive 32. A protective sleeve 33 isolates the washer from access by a child. The sleeve 33 may be equipped with straps of closure material in the manner described above. Sleeve 33 is slotted at 33A to facilitate assembly of the device.

In FIG. 6 the attachment means is further modified by the substitution of a flexible metal clip 35 having arms 36-37 which flex in opposite directions during gripping engagement with a tubular support 38 in a clip-on manner.

In use, the device may be readily applied to various structures without risk of damage to same. At the end of a period of use, the device may be left in place as a reminder or conveniently removed and stored until subsequent use.

While I have shown but a few embodiments of the invention, it will be apparent to those skilled in the art that the invention may be embodied still otherwise without departing from the spirit and scope of the claimed invention.

Having thus described the invention, what is desired to be secured by a Letters Patent is:

1. An exercising device for arm and hand muscles for securement to a stationary support, said device comprising, a resilient body defining an opening extending therethrough, flexible attachment means including straps for engagement with a support in a detachable manner, and retention means for anchoring said flexible attachment means in place on said resilient body and including an elastic member extending through said opening, end members attached to the elastic member and biased by the elastic member into engagement with the resilient body, one of said end members overlying one of said straps.

2. The device claimed in claim 1 wherein the tensioned element is an elastic cord.

3. The device claimed in claim 1 wherein said straps have fabric closure elements thereon.

* * * * *